United States Patent [19]

Lynn

[11] Patent Number: 4,535,662

[45] Date of Patent: Aug. 20, 1985

[54] METHOD AND APPARATUS FOR GATHERING BEVERAGE STRAWS AND THE LIKE

[76] Inventor: Homer S. Lynn, 5300 Dublin Rd., Dublin, Ohio 43017

[21] Appl. No.: 588,779

[22] Filed: Mar. 12, 1984

[51] Int. Cl.[3] ..... B26D 3/16

[52] U.S. Cl. ..... 83/23; 83/101; 83/112; 83/150; 83/160; 83/115; 414/745

[58] Field of Search ..... 83/84, 86, 112, 155, 83/101, 150, 161, 162–167, 175, 176, 580, 23, 115; 414/92, 745; 264/150

[56] References Cited

U.S. PATENT DOCUMENTS

| | | | |
|---|---|---|---|
| 2,142,271 | 1/1939 | Herrmann | 83/161 X |
| 2,575,417 | 11/1951 | Heyman | 83/580 X |
| 3,180,481 | 4/1965 | Brause . | |
| 3,263,825 | 8/1966 | Elam | 414/745 |
| 3,291,009 | 12/1966 | Davis et al. . | |
| 3,441,637 | 4/1969 | Davis . | |
| 3,648,553 | 3/1972 | Tuschy | 83/165 X |
| 3,762,254 | 10/1973 | Tsymbal | 83/167 X |
| 4,266,455 | 5/1981 | Ago | 83/155.1 X |
| 4,338,060 | 7/1982 | Swaby | 414/92 X |

*Primary Examiner*—James M. Meister

*Attorney, Agent, or Firm*—William S. Rambo; William Cates Rambo

[57] ABSTRACT

The leading end of a continuous tubular supply is fed past a rotating flywheel into a guide. When the leading end reaches the back of the guide, a blade mounted on the flywheel severs the supply to form a straw or stirring stick. The straw is immediately ejected from the guide and is swept into the entrant portion of a feeder by a rotary brush. The feeder is provided with a stem-propelling run that is formed from a pair of top V-belts and a wide underbelt and between which the straw is propelled to a collecting hopper. Successive straws are pushed into the hopper under the impetus of the conveyor belts.

6 Claims, 5 Drawing Figures

METHOD AND APPARATUS FOR GATHERING BEVERAGE STRAWS AND THE LIKE

BACKGROUND OF THE INVENTION

The present invention relates to apparatus and methods of making beverage straws, stirring sticks and the like, and more particularly to equipment and procedures employed in gathering such items preparatory to packaging.

Typically, drinking straws, stirring sticks and other beverage stems are manufactured from polypropylene or other suitable polyolefins and are extruded into a continuous, tubular advancing supply. The hot and semi-solid tubular supply is then guided through an elongated water bath where it is cured. After the leading end of the supply emerges from the bath, it is segmented at regular intervals by a rotating blade. The length of the resulting straws or stirring sticks is determined by the time interval between cuts and by the speed of the advancing supply.

Most beverage stems are extremely lightweight and, especially if fabricated from synthetic resin material, develop a static charge during manufacture. In the past, the leading end of the advancing supply projected outwardly into space on the opposite side of the cutting mechanism from the main body of the supply. The cutter then lopped off this outwardly projecting end of the supply to form the desired straw or stir stick. Ideally, the beverage stem would then fall onto a collecting surface where it would be easily collected for packaging. In practice, however, the individual straws tend to scatter when severed from the supply. Their lightness and static charge causes them to stray in all directions under the impact of the blade and the air turbulence created by the rotating cutting mechanism. A substantial amount of waste results, as many of the straws or stirrers drop outside of the collecting area and become contaminated. Those that land on the collecting surface are so randomly positioned as to require almost constant attention by the person responsible for gathering and packaging them. Thus, the rate of manufacture was limited, to a degree, by the speed of the attendant. In addition, the wall thickness and, hence, material content of each beverage stem could not be reduced below a certain level because the cost of retrieving and gathering them would eliminate any savings in raw material.

U.S. Pat. No. 3,441,637 issued Apr. 29, 1969 to H. E. Davis discloses a moving conveyor belt onto which stirring sticks drop after being cut from an advancing supply. A baffle is positioned near the discharge end of the conveyor to back up the stirring sticks in parallel relation to one another. The stirrers are then manually removed from the conveyor and suitably packaged. While the moving conveyor and collecting baffle disclosed in the Davis Patent made the attendant's task somewhat easier, the beverage stems remained free floating during the cutting stage to scatter in every direction.

In contrast to the gathering apparatus disclosed in the Davis Patent, the present invention prevents the beverage stems from scattering by controlling their movement from the time they are severed from the advancing supply until they reach a holding receptacle. U.S. Pat. No. 3,180,481 issued Apr. 27, 1965 to Brause which, along with the Davis Patent, represents the closest prior art known to the inventor, teaches the use of conveyors and rotary brushes bearing some resemblance to a portion of the feeder for the present invention. The Brause Patent, however, concerns the apparatus employed in moving paper through a document sorter and lacks the continuous control devices employed in the present invention to gather drinking straws, stirrers and other beverage stems.

SUMMARY AND OBJECTS OF THE INVENTION

The present invention comprises an apparatus and a method of gathering an axially extending tubular beverage stem from a cutting device that severs the stem from an axially advancing elongated supply. The apparatus according to the present invention consists basically of a substantially stationary stem-receiving guide disposed on an opposite side of the cutting mechanism from the supply; at least two relatively aligned endless belts that define a stem-transporting run having an entrant portion disposed adjacent to the guide and a discharge portion disposed downstream of the entrant portion; a brush rotatably mounted adjacent to the entrant portion of the run and disposed to maintain substantially constant contact with the stem between the guide and the entrant portion of the run; a collecting station having a relatively restricted stem-receiving opening extending into the discharge portion of the run; and means for driving the belts and the brush. The method according to the present invention comprises advancing the stem into a substantially stationary guide disposed downstream of the cutting mechanism; severing the stem from the supply while a substantial portion of the stem is in the guide; brushing the stem from the guide into an adjacent entrant portion of a stem-transporting run defined by at least two relatively aligned belts after the stem is severed from the supply; maintaining substantially constant contact with the stem as it is brushed from the guide into the entrant portion of the run; and forcing the stem into a collecting station having a relatively restricted stem receiving opening extending into a discharge portion of the stem-transporting run.

The present invention provides a number of advantages over the prior art. It reduces the amount of manual labor devoted to packaging drinking straws, stirrers and the like. It minimizes the waste resulting from product spillage and dispersion during the manufacturing, conveying and packaging operations. The present method and apparatus also permit production rates to be substantially increased and less raw material to be used in each straw or stirrer. These and other objects and advantages may be more readily perceived in view of the following drawings and detailed description.

DETAILED DESCRIPTION OF THE PREFERRED EMBODIMENT

Figure 1:
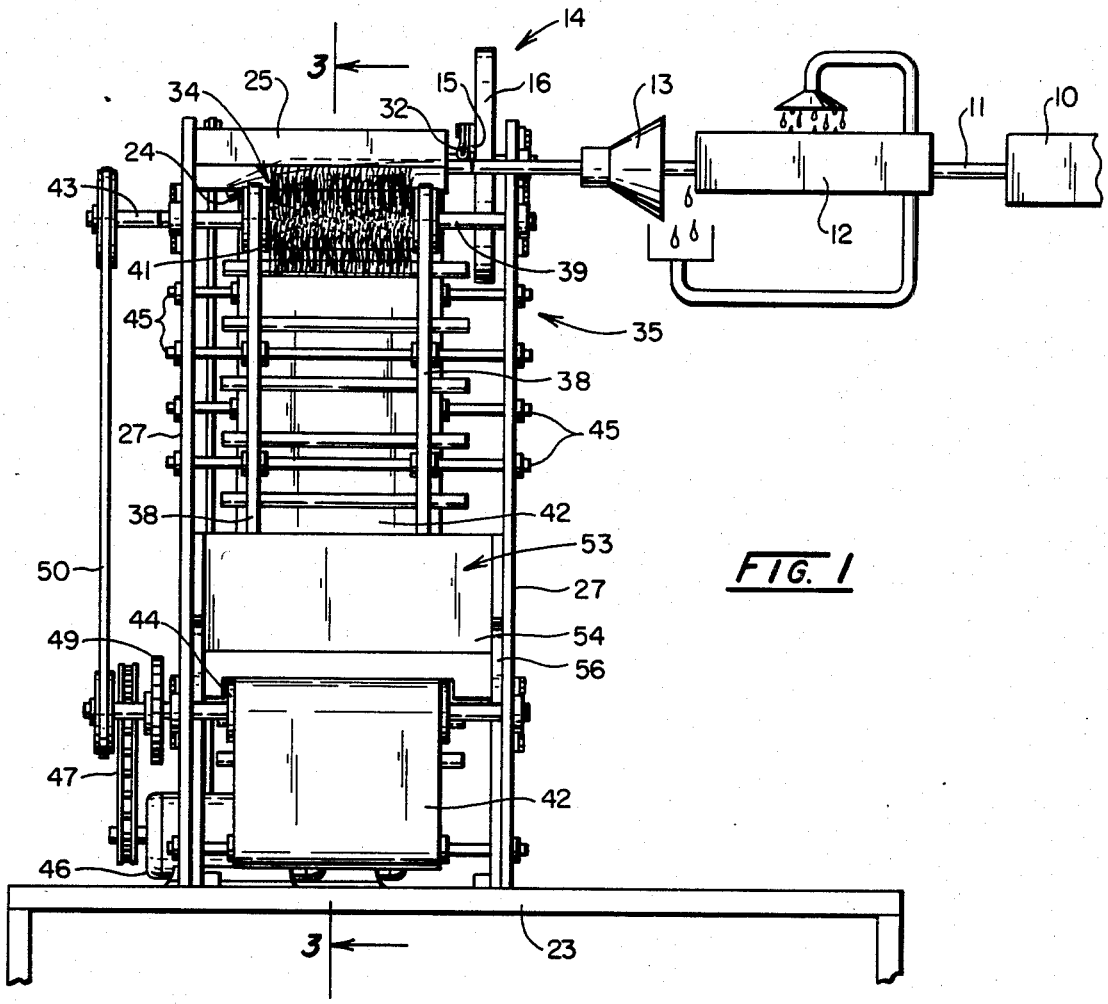
FIG. 1, is a front elevational view of an apparatus according to the present invention for gathering drinking straws and the like and includes a diagramatic representation of the equipment employed in manufacturing an elongated, tubular supply therefor.

As indicated diagramatically in FIG. 1, an extruding machine 10, the nozzle or die portion of which is shown, is adapted to extrude thermoplastic materials such as polypropylene, polyethylene, and the like. As will be understood by those familiar with the art, a granular form of the thermoplastic material is fed into the extruder, whereupon it is heated to a semi-solid state in the extruder's barrel and forced therethrough by a suitable screw driven mechanism. An extruder mandrel, not shown, extends through the die portion 10 of the extruder, and a continuous, axially elongated, advancing tube or supply 11 is emitted therefrom. Alternatively, an additional strip of thermoplastic material may be coextruded in a spiral pattern onto the outer surface of the supply to create a twisted pattern. The internal and external diameters of the tubular supply may be selected from a wide range, and the present invention is adapted for use with practically any size of drinking straw, stirring stick or the like.

Once extruded, the hot advancing supply 11 enters an elongated water tank 12 that is maintained at a temperature of approximately 68°. The synthetic resin material is cured in the tank or bath 12, thereby fixing its tubular shape while preserving a sufficient degree of flexibility. Upon leaving the tank, the continuous tube passes through a guide funnel 13 that is substantially axially aligned with the supply and that positions and supports it during the cutting operation.

Figure 2:
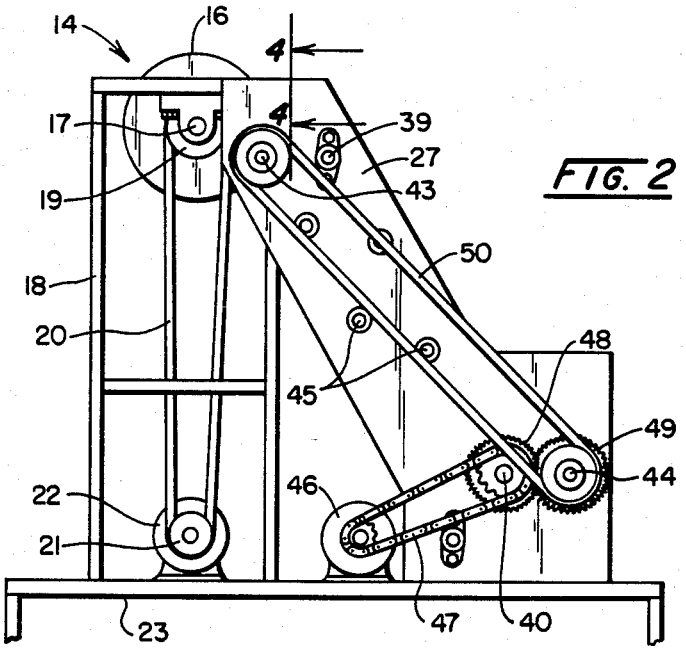
FIG. 2 is a reduced side elevational view of a preferred arrangement of the means for driving the feeder and cutting mechanism.

The cutting mechanism 14, as indicated in FIGS. 1 and 2, comprises a blade 15 rigidly secured to and projecting radially outwardly from a flywheel 16. The flywheel 16 is secured to a shaft 17 which is rotatably mounted in bearings housed on a support frame 18. The rotatable shaft is disposed on the support frame 18 so that the flywheel and blade are substantially perpendicular to the axis of the advancing supply. A pulley 19 is secured to the shaft 17 in spaced relation to the flywheel 16. A V-belt 20 engages the flywheel pulley 19 and extends downwardly into engagement with a lower pulley 21 that is rigidly secured to the rotary shaft of an electrically powered motor 22. The electric motor 22 and the support frame 18 are mounted upon a deck 23, and a protective shroud (not shown) preferably surrounds the cutting mechanism 14, as well as other portions of the present apparatus. The flywheel 16 and the shaft 17 are laterally offset from the axis of the guide funnel 13 and the advancing supply 11 so that the blade 15 is substantially directly above said supply when contact is made. As may be readily understood, the speeds of the advancing tubular extrusion 11 and flywheel 16 determine the length of the severed beverage stem 24. While it is also possible to increase the number of blades on the flywheel to obtain a proportional decrease in the length of the stem, this technique is not routinely employed.

Figure 4:
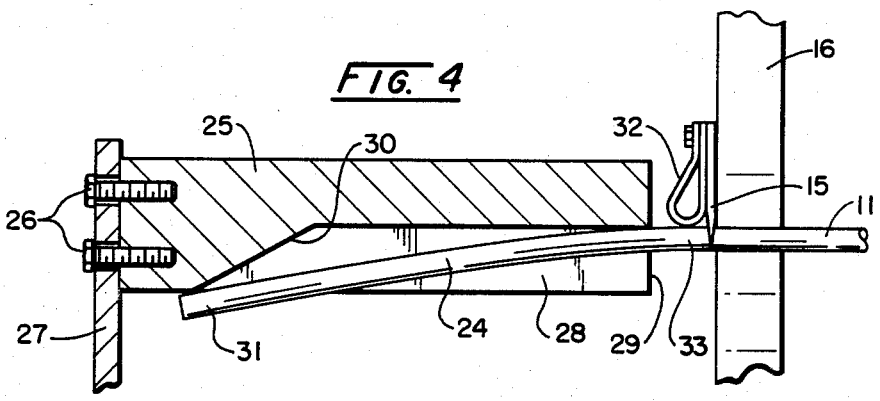
FIG. 4 is an enlarged vertical sectional view taken along line 4—4 of FIG. 2, and illustrates particularly the preferred means of ejecting the beverage stem from the guide.

As indicated in FIGS. 1 and 4, a substantially stationary stem-receiving guide 25 is disposed on an opposite side of the cutting mechanism 14 from the advancing supply 11. The guide or bar 25 is rigidly secured by screws 26 or other fasteners to a vertical support plate 27 and is formed with a downwardly opening channel 28 axially aligned with the supply 11. The channel 28 is formed with a stem-receiving open end 29 and with a downwardly inclined closed end 30. The channel 28 and guide 25 are sized so that the leading end 31 of the straw or stirrer 28 advances into the guide 25 after the blade 15 has rotated out of axial alignment with the supply. By the time the blade has returned to sever the straw or stirrer 24 from the supply, a substantial portion of the straw has advanced into the channel 28. In this manner, the straw is sufficiently confined by the guide to be properly located under the blade for complete severance from the supply. In addition, confinement in the guide prevents the straw or stirring stick from sailing off in an undesired direction when cut from its supply and protects it from the moving elements of the feeder as described below.

Upon separation from the advancing supply tube 11, the beverage stem 24 is ejected from the guide 25. This is accomplished, preferably, without relying upon gravity because some of the straws and stirrers do not possess sufficient mass to overcome the static electrical charge that attracts and holds them to the guide. Instead, ejection or displacement from the guide may be accomplished through the combined effects of the leading end 31 of the stem advancing against the inclined closed end 30 of the guide channel 28 and the blade 15 or, alternatively, a shoulder member or striker 32 urging the trailing end 33 of the straw downwardly. As indicated in FIG. 4, the lower edge of the inclined closed end 30 of the guide channel 28 is spaced from the blade-bearing side of the flywheel 16 a distance sufficient to permit the leading end 31 of the straw to project downwardly from the channel 28. The screws 26 that secure the guide 25 to the rear support plate 27 are readily accessible so that a plurality of guides having differently dimensioned channels are easily removed and installed as the lengths of the straw or stirrer is changed.

The flywheel shaft 17 (FIG. 2) is preferably disposed on the support framework 18 so that the blade 15 is directly above the straw when the cut is made. The shank of said blade possesses sufficient thickness, so that, in many cases it is able to urge the trailing end 33 of the straw or stirrer downwardly out of the guide channel 28. Upon occasion, however, some beverage straws tend to adhere to the guide channel, and it is necessary to install a shoulder member or striker 32. Said striker is preferably a strip of flexible, synthetic resin material that is doubled over to reduce its flexibility, and is secured at its open ends to the blade 15 and flywheel 16. The closed end of the striker is disposed sufficiently above the cutting edge of the blade to permit the blade to pass entirely through the beverage stem before the striker engages said stem. Substantially immediately after the straw is severed, however, the looped shoulder member 32 meets the cylindrical wall of the tube. Advantageously, the flexibility of the striker prevents it from fracturing the trailing end 33 of the stem upon impact. In addition, the striker is inexpensive and readily replaceable, as it is subject to a relatively large amount of wear.

It may also be noted, in view of FIG. 4, that the resiliency of the beverage stem itself contributes to its ejection or displacement from the guide 25. The alignment funnel 13 (FIG. 1) and other pilots disposed near the flywheel keep the trailing end of the stem substantially axially aligned with the advancing supply 11 until the stem is cut by the blade. The leading end 31, however, bends downwardly as it advances against the inclined end 30 of the channel. As a result of the stem's inherent resiliency, it springs downwardly out of the guide when severed from the supply. Thus, the beverage stem is positively ejected from the guide substantially immediately after it is severed from the supply by a number of mechanisms and forces without relying upon gravity.

Since the ejection of the beverage stem from the guide follows its separation from the supply by no more than a fraction of a second, the guide is cleared of the stem well before the blade 15 and striker 32 have rotated entirely out of the path of the advancing supply. Accordingly, it is not necessary to halt or divert the advancing supply. A new straw or stirrer is begun as the leading end of the supply advances past the flywheel 16 and enters the guide 25. By coordinating the velocities of the supply and flywheel and the length of the stem-receiving guide channel 28, the leading end 31 of the new stem will begin to project from the bottom edge of the guide at the same time as the blade 15 completes one rotation and severs the supply. Ordinarily, a single revolution of the flywheel is completed within the range of 0.5 to 3.0 seconds. During this period of time, what has arbitrarily been chosen as the first beverage stem has advanced along the present apparatus in the manner described below so that a space is provided between each successive stem.

Figure 3:
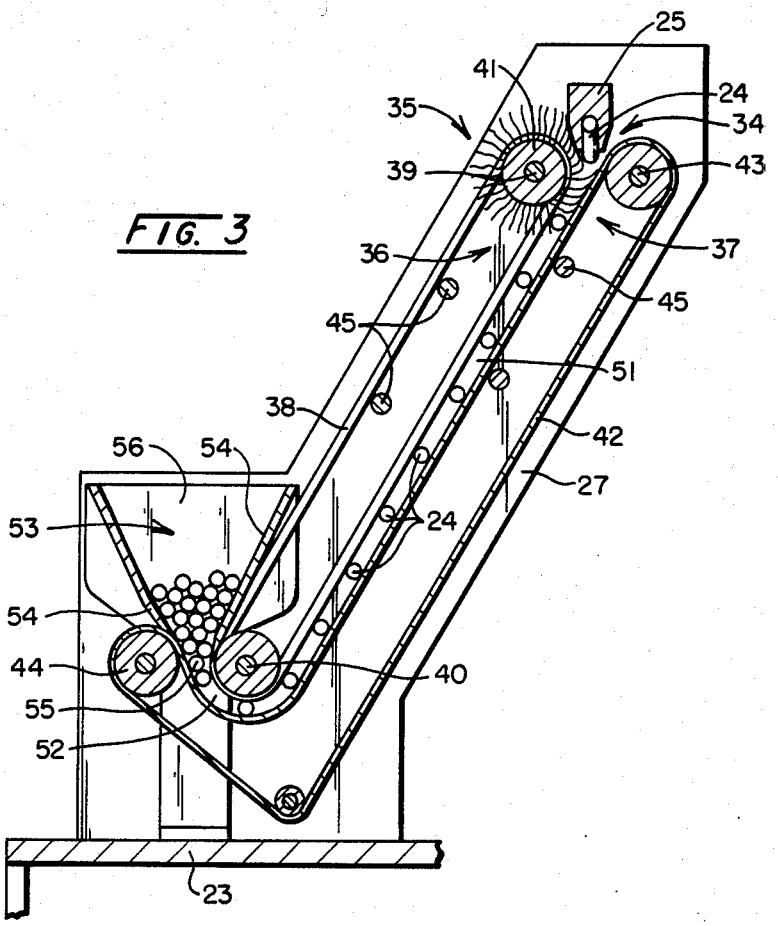
FIG. 3 is a vertical sectional view taken along line 3—3 of FIG. 1, particularly illustrating the manner in which the feeder gathers beverage stems from the guide and urges them into the collecting station.

As indicated in FIGS. 1 and 3, the beverage stems 24 are drawn or carried into an entrant portion 34 of a feeder mechanism 35 after being displaced from the guide. The feeder is defined by a top conveyor assembly 36 and a floor conveyor assembly 37. The top conveyor 36 is formed with a pair of V-belts 38 disposed in relatively spaced apart relation on pairs of belt-receiving pulleys secured to an upper coaster shaft 39 and a lower drive shaft 40. In addition, a rotary brush 41 is mounted on the upper coaster shaft 39 between the belt pulleys. The floor conveyor assembly 37 is formed with a relatively wide and flat underbelt 42 rotatably mounted on upper and lower drive drums and cooperative shafts 43 and 44, respectively. Both conveyors are provided with a plurality of idlers or belt tighteners 45 by which the positions of and tension on the V-belts 38 and flat belt 42 may be adjusted. The upper and lower shafts and the idlers of both conveyors are rotatably housed or otherwise mounted at opposite ends in bushings or housings disposed on a pair of laterally spaced apart, vertically extending support plates 27. Each of said plates 27 includes a base portion mounted on the deck 23 and an upwardly inclined portion secured to the cutter support frame 18.

As indicated in FIGS. 1 and 2, the preferred drive means for the conveyor assemblies is predominantly disposed in outwardly spaced relation to the support plate 27 that is furthest from the cutting blade 15. Both the top and floor conveyors are driven by a single electrically powered motor 46 mounted on the deck 23 and by a transmission operatively engaging the motor and feeder. The transmission comprises a roller chain 47 mounted on sprockets secured to the drive shaft of the motor 26 and to the lower drive shaft 40 of the top conveyor. Identical gears or pinions 48 and 49 are secured in meshing relation with one another on the lower shaft 40 of the top conveyor and on the lower drum shaft 44 of the floor conveyor. Said lower drum shaft 44 and the upper drum shaft 43 of the floor conveyor are each provided with an identical pulley secured thereto, and a drive belt 50 is mounted on and extends between said pulleys.

As illustrated in FIG. 3, the idlers 45, upper and lower shafts 40 and 41 and drums 43 and 44 are rotatably mounted on the support or end plates 27 so that the V-belts 38 are disposed in closely and uniformly spaced, facing relation to the flat belt 42 over relatively inturned portions 51 of their respective runs. Furthermore, both the top and floor belts are traveling downwardly at the same speed through said inturned portion 51 of their runs.

The directions and velocities of the conveyors are established initially by the motor 46, chain drive 47, meshing gears 48 and 49, and belt drive 50. With reference to FIG. 2, it may be understood that when the motor 46 rotates the roller chain 47, V-belt gear 48 and lower shaft 40 in a counter-clockwise direction, the flat belt gear 49, drive belt 50 and roller shafts 43 and 44 rotate at the same velocity in a clockwise direction. With reference to FIG. 3, then, it follows that both the top and floor conveyors are moving downwardly through the inturned portion 51 of their runs. And, since the flat belt drums 43 and 44 and the V-belt pulleys on the shafts 39 and 40 are identical in diameter, the V-belts and flat belt are traveling at the same speed.

As indicated in FIG. 3, the entrant portion 34 of the feeder mechanism is defined by the upper turns of the belts 38 and 42 around their respective pulleys and drum. Said upper turns of the belts are disposed at substantially the same height on the end plates 27, and the stem-receiving guide 25 is mounted on the outermost end plate so that the lowermost edge thereof is approximately $\frac{3}{4}''$ above an imaginary center line extending between the upper pulley shaft 39 and upper drum shaft 43. The spaces between the brush 41, underbelt 42 and guide 25 are such that the bristles of the brush contact the guide and the underbelt as the brush is rotated by the V-belts 38. The brush is rotated in clockwise fashion relative to FIG. 3. In this manner, the bristles pick up each beverage stem 24 substantially immediately as it is ejected from the guide and draw or carry it a relatively short distance into the entrant portion of the feeder.

Once the brush carries the stem 24 into the entrant portion, said stem is swept downwardly between the inturned portions 51 of the belts. The brush carries the straw or stirrer onto a descending portion of the floor belt 42 and, since the brush rotates at substantially the same speed as the flat belt, the brush holds the straw in place on said belt. While being held against the flat belt by the brush bristles, the stem engages the twin V-belts 38 of the top conveyor. As previously indicated, the space between the inturned portions of the V-belts and underbelt is sufficiently small to hold the straws therebetween. Since the belts travel at substantially the same speed, the straws are held stationary relative to the belts.

A discharge portion 52 of the feeder begins at the bottom of the inturned run 51 of the belts. At this point, the V-belts 38 round the lower pulleys secured to the drive shaft 40 and return to the upper pulleys on the passive shaft 39. The lower drum shaft 44 and lower V-belt shaft 40 are mounted on the end plates 27 at substantially the same height. In addition, the drum and pulleys mounted on said shafts are substantially equal in diameter and are spaced from one another so that the flat belt 42 does not begin to diverge from the V-belts until just before it engages the lower drum 44. Thus, the discharge portion 52 of the underbelt 42 is defined by a curve or sag as said belt approaches the lower drive drum 44.

The shape of the upwardly curving, discharge portion 52 of the underbelt is held substantially constant by driving both the upper and lower drums 43 and 44 at the same speed. This is accomplished, as previously indicated, with the drive belt 50 (FIG. 2) extending between the pulleys secured to the free ends of the drum-driving shafts 43 and 44 projecting from the rear support plate 27. If only the lower belt drum 43 were driven, the discharge portion 52 of the underbelt would be urged towards the lower V-belt pulleys 40 by the inherent inertia and drag of the floor conveyor assembly. As a result, an excessive amount of pressure would be exerted on the beverage stems 24 as they travel through the discharge portion of the feeder run, with the likely result that the V-belt-engaging portions of said stems would be dented or crushed. On the other hand, if only the upper belt drum 44 were driven, the discharge portion would tend to sag due to the same forces. In this case, the straws or stirrers would lose contact with the V-belts, and their progress through the feeder would slow or stop. The straws would not be propelled into a collecting receptacle 53, as described below, and would accumulate and jam at the end of the conveyor run. Thus, it is necessary, at least with the feeder in its present configuration, to drive both the upper and lower drums of the bottom belt 42 so that a substantially constant pressure is exerted by said belt to hold the stems 24 against the V-belts.

Figure 5:
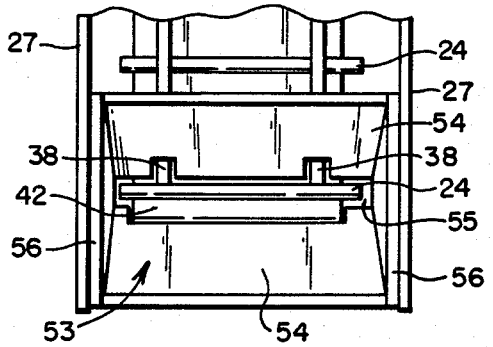
FIG. 5 is a top plan view of an empty collecting receptacle and illustrates particularly the spatial relationships between the stem-receiving opening of the collecting station and the discharge portion of the feeder.

As best indicated in FIGS. 3 and 5, the collecting receptacle 53 is formed with a pair of opposing and converging walls 54 that terminate between the lower pulleys 40 and drum 44 of the conveyor belts to define a relatively restricted, stem-receiving opening 55. The converging walls 54 extend laterally between the end plates 27, and the stem-receiving opening 55 is disposed substantially immediately above the discharge portion 52 of the feeder. Preferably, the bottom edges of the converging walls are notched or otherwise shaped to receive segments of the V-belts 38 and flat belt 42 as they rotate around their respective pulleys and drum. In this manner, the bottom edges of the converging walls may be disposed between the flat belt and V-belts closer to the point where the space between them begins to widen without interfering with the rotation of said belts. Thus, there are no substantial gaps between the opening of the hopper and the discharge portion of the feeder through which the stems may escape.

Once the stem reaches this area of divergence, it is no longer propelled by the belts and its progress toward the hopper is momentarily halted, because the distance between the upper and lower belts becomes slightly greater than the diameter of the beverage stems. Shortly thereafter, however, it is pushed upwardly towards the hopper opening when the next stem spaced immediately behind it in the feeder reaches the area of divergence. Thus, the feeder propels each succeeding stem into the belt-diverging area and, in so doing, provides the force by which the stems are able to push each other upwardly into and within the collecting receptacle. Accordingly, it is important that the distance between the stem-receiving opening of the receptacle and the beginning of the belt-diverging area of the feeder be as small as possible so that the stems do not become wedged between the converging walls and the belts.

The propulsive force exerted by the conveyor belts is sufficient to urge successive straws or stirrers upwardly and to overcome the weight of those already collected in the hopper. Advantageously, the converging walls 54 act like a one-way valve that permits the straws to form a self-supporting wedge once a sufficient number have collected in the hopper without impeding the ingress of additional straws.

The hopper 53 is provided with relatively opposing end walls 56 that close off the opening at opposite ends of the converging walls 54 and that preferably extend downwardly into hopper-supporting legs. Said legs are configured so that the hopper is readily removable from its position over the discharge portion of the feeder. In this manner, a number of differently sized, interchangeable hoppers may be provided for collecting straws or stirrers of different lengths. The end walls 56 and converging walls 54 are formed so that the beverage stems lie in closely spaced, parallel relation to one another with their ends substantially aligned. Once the hopper has filled sufficiently, the attendant grasps a handful of beverage stems and boxes or otherwise packages them. Alternatively, automatic bundling and/or packaging equipment may be devised. In any case, the present invention eliminates the need for the attendant to be constantly gathering and arranging the finished product for packaging as it spews from the cutter. Instead, the operator is free to supervise the machinery and package the output for more than one of the present beverage stem gathering machines.

It may also be noted that the straws and stirrers gathered by the present invention are substantially constantly confined and controlled by the guide, feeder and collecting receptacle from the moment they are severed from the supply until removed from the hopper. In this manner, the density of each beverage straw, and hence, the amount of raw material used, may be decreased without concern that the dispersion of the stems upon cutting will increase.

While a single preferred embodiment of the present invention has been described in some detail, the present disclosure is not intended to unduly limit or restrict either the invention or the scope of the following claims.

I claim:

1. Apparatus for gathering an axially extending tubular beverage stem from a cutting mechanism that severs said stem from an axially advancing elongated supply, said apparatus comprising, in combination:

(a) a substantially stationary stem-receiving guide disposed downstream of said cutting mechanism;

(b) at least two relatively aligned endless belts that define a stem-transporting run having an entrant portion disposed adjacent to the guide and a discharge portion disposed downstream of said entrant portion;

(c) a brush rotatively mounted adjacent to the entrant portion of the run and disposed to maintain substantially constant contact with the stem between the guide and the entrant portion of said run;

(d) a collecting station having a relatively restricted stem-receiving-opening extending into the discharge portion of the run; and (e) drive means for the belts and the brush.

2. Apparatus according to claim 1, wherein said guide is formed with an elongated channel having a stem-receiving open end proximal to the cutting mechanism and an inclined closed end distal to said cutting mechanism for urging a leading end of the stem into contact with the brush.

3. Apparatus according to claim 1, wherein a striker is mounted on the cutting mechanism adjacent to a cutting edge thereof for engaging a trailing end of the stem and urging said trailing end towards the belts.

4. Apparatus according to claim 1, wherein the stem-transporting run defined by said belts is provided with a bend in an intermediate portion thereof.

5. Apparatus according to claim 1, wherein said stem-transporting run is defined by a pair of laterally spaced-apart upper belts and by a relatively wide bottom belt.

6. The method of gathering an axially extending tubular beverage stem from a cutting mechanism that severs said stem from an axially advancing elongated supply, said method comprising:

(a) advancing the stem into a substantially stationary guide disposed downstream of said cutting mechanism;

(b) severing the stem from the supply while a substantial portion of said stem is in the guide;

(c) brushing the stem from the guide into an adjacent entrant portion of a stem-transporting run defined by at least two relatively aligned belts after said stem is severed from the supply;

(d) maintaining substantially constant contact with the stem as it is brushed from the guide into the entrant portion of said stem-transporting run; and (e) forcing the stem into a collecting station having a relatively restricted stem receiving opening extending into a discharge portion of the stem-transporting run.

* * * * *